US007509087B2

(12) United States Patent
Lin

(10) Patent No.: US 7,509,087 B2
(45) Date of Patent: Mar. 24, 2009

(54) SCANNING SYSTEM WITH SCANNING WINDOW HAVING ELEVATED EDGE OPTIMIZED FOR COPYING BOUND BOOKS

(75) Inventor: Chin-Piao Lin, Taipei (TW)

(73) Assignee: Plustek Inc., Taipei (TW)

( * ) Notice: Subject to any disclaimer, the term of this patent is extended or adjusted under 35 U.S.C. 154(b) by 0 days.

(21) Appl. No.: 10/922,961

(22) Filed: Aug. 23, 2004

(65) Prior Publication Data

US 2005/0019072 A1 Jan. 27, 2005

Related U.S. Application Data

(63) Continuation-in-part of application No. 10/681,660, filed on Oct. 8, 2003, now abandoned.

(30) Foreign Application Priority Data

Mar. 25, 2003 (TW) ..... 92204570 U

(51) Int. Cl.
*G03G 15/00* (2006.01)

(52) U.S. Cl. ..... 399/365

(58) Field of Classification Search ..... 399/365; 359/201; 358/506, 488

See application file for complete search history.

(56) References Cited

U.S. PATENT DOCUMENTS 3,775,008 A 11/1973 Schaeffer et al.
5,475,505 A * 12/1995 Minasian et al. ..... 358/474
5,519,482 A * 5/1996 Johdai et al. ..... 399/396
5,751,461 A * 5/1998 Chen et al. ..... 359/201
5,881,339 A * 3/1999 Yanagida et al. ..... 399/101
2002/0191994 A1* 12/2002 Lee ..... 399/362
2003/0234962 A1* 12/2003 Haas et al. ..... 358/474
2004/0169894 A1* 9/2004 Schroath et al. ..... 358/474
2005/0237584 A1* 10/2005 Lee et al. ..... 358/474
2005/0243386 A1* 11/2005 Sheng ..... 358/506

* cited by examiner

*Primary Examiner*—Quana M Grainger

(57) ABSTRACT

A scanning system for scanning a document placed on a document platen and for projecting an image onto a photosensitive image medium to form a latent image of the document thereon including a housing, a photosensitive scanner, and a scanning window is provided. The photosensitive scanner is adapted to move beneath the platen in a scan operation for projecting the image onto the photosensitive image medium to form the latent image. The scanning window is mounted on a ceiling of the housing and a fringe of the scanning window bordered with a frame, wherein a top surface of the scanning window is substantially equal to or higher than that of the one side of the frame in height. Furthermore, another scanning system for scanning two pages of a book and projecting an image onto a photosensitive image medium to form a latent image of the document thereon is provided.

3 Claims, 8 Drawing Sheets

SCANNING SYSTEM WITH SCANNING WINDOW HAVING ELEVATED EDGE OPTIMIZED FOR COPYING BOUND BOOKS

CROSS-REFERENCED APPLICATION

This is a Continuation-In-Part (CIP) application of a previously filed application having application Ser. No. 10/681,660 filed on Oct. 8, 2003, now abandoned which is incorporated by reference herein in its entirety and which claims the benefit of Taiwanese application Serial No. 092204570 filed Mar. 25, 2003, which is also incorporated by reference herein in its entirety.

FIELD OF THE INVENTION

The present invention relates to a scanning system, and more particularly to a scanning system for copying documents or bound books.

BACKGROUND OF THE INVENTION

Conventionally, the key elements of the scan system are a photosensor, an illumination lamp such as a fluorescent lamp or an array of light emitting diodes, a set of lenses, a motor, and a power supply. The scanning operation of the prior art scan system is described as follows: The illumination lamp illuminates a flat document, or a bound document, such as a book. The image is reflected along an optical axis, projected through lens and reflected through mirror onto the surface of a photoreceptor drum or a charge-coupled device, CCD. The scanning operation is satisfactory for most applications, but is less than satisfactory for those systems which afford a book copying capability. Because of a binding edge of a book, the sensed light intensity of the binding edge is different.

Furthermore, the copying of non-planar originals, such as bound books, presents a problem because it is difficult to copy the information adjacent the binding of the book. The difficulties of reproduction in the binding area results from the portion of the book adjacent the binding being lifted away from the original image plane, which is usually defined by a planar transparent plate. The quality of the reproduction decreases in relation to increasing distance of the original image from the image plane. The lack of clarity and/or distortion in the copy results from several factors including 1) the projected image becomes increasingly out of focus as the original is scanned in the central binding area; 2) the illumination becomes less than optimal in the spine area; 3) there is compression of the image data along the scan length; and 4) there is degradation of the definition of the image data resulting from the original image being disposed at an angle to the image plane.

Nowadays, there are some inventions utilizing automatic electronic image correction technique to correct the book curve caused by the binding edge of a book. Although the book scanner system such as OMNISCAN 5000TT/5100TT is convenient and easy to digitize and/or copy books and bound documents and guarantees that the book bindings are not damaged, however, it is too expensive to use the instrument for the general public.

Another approach is to modify the platen to have a sloping edge portion so that the bound part of the book is placed in a corner position so that the entire surface of the page being copied is in intimate contact with the platen surface. An example of such a system is disclosed in U.S. Pat. No. 3,775,008. These systems have a disadvantage. The magnification range is limited because of restriction on scanner movement in the sloping corner edge.

In addition, the illumination lamp generally is a fluorescent lamp; however, the light intensity of the two ends of the fluorescent lamp is smaller than the central part thereof. The prior art method and apparatus is to increase the length of the fluorescent lamp to increase the usable scan zone. Thus, the volume of the scan system must be increased.

It is therefore attempted by the applicant to deal with the above situation encountered with the prior art.

SUMMARY OF THE INVENTION

It is therefore an object of the present invention to improve the photocopying of nonplannar original images, such as books.

It is therefore another object of the present invention to combine the convenience and functionality of split scan scanning with the accuracy of book edge copying.

It is therefore further object of the present invention to accomplish the foregoing objectives with minimum modification and effectively shorten the width of the frame 13 so as to provide a larger scan zone.

It is therefore still further object of the present invention to provide a scanning system for scanning the entire surface of two consecutive pages of the book which are simultaneously copied.

According to an aspect of the present invention, the scanning system for scanning a document placed on a document platen and for projecting an image onto a photosensitive image medium to form a latent image of the document thereon includes a housing, a photosensitive scanner, and a scanning window. Meanwhile, the photosensitive scanner is adapted to move beneath the platen in a scan operation for projecting the image onto the photosensitive image medium to form the latent image. The scanning window is mounted on a ceiling of the housing and a fringe of the scanning window bordered with a frame, wherein a top surface of the scanning window is substantially equal to that of the one side of the frame in height. Furthermore, another scanning system for scanning two pages of a book and projecting an image onto a photosensitive image medium to form a latent image of the document thereon is provided.

Preferably, the photosensitive scanner is a charge-coupled device.

Preferably, the photosensitive scanner is a contact image sensor.

Preferably, the scanning system further includes an orientation slot disposed on one side of the frame.

Preferably, the scanning window has a downwardly sloping plane engaged with the orientation slot.

Preferably, the orientation slot includes an upper portion and a lower portion in which the upper portion has a downwardly sloping plane and the lower portion has a horizontal plane to form the orientation slot.

Preferably, the scanning window is an exposure glass.

According to another aspect of the present invention, the scanning system for scanning a document placed on a document platen and for projecting an image onto a photosensitive image medium to form a latent image of the document thereon includes a housing, an illumination lamp, and a scanning window. The illumination lamp is adapted to move beneath the platen in a scan operation for projecting the image onto the photosensitive image medium to form the latent image and two terminals of the illumination lamp having L-shaped structures. The scanning window is mounted on a ceiling of the housing and a fringe of the scanning window bordered with a frame, wherein a top surface of the scanning window is substantially equal to that of the one side of the frame in height.

Preferably, the illumination lamp is a fluorescent lamp which has two L-shaped structures.

Preferably, the illumination lamp is an array of light emitting diodes.

The present invention may best be understood through the following description with reference to the accompanying drawings, in which:

BRIEF DESCRIPTION OF THE DRAWINGS

FIG. 2-1 is a cross-sectional view along A-A line of FIG. 1;

FIG. 2-2 is a partial view of FIG. 2-1; and

FIG. 5-1 is a cross-sectional view along B-B line of FIG. 4;

FIG. 5-2 is a partial view of FIG. 5-1; and

DETAILED DESCRIPTION OF THE PREFERRED EMBODIMENT

Although this invention is susceptible to embodiments of many different forms, a preferred embodiment will be described and illustrated in detail herein. The present disclosure exemplifies the principle of the invention and is not being considered a limitation to the broader aspects of the invention to the particular embodiment as described.

Figure 1:
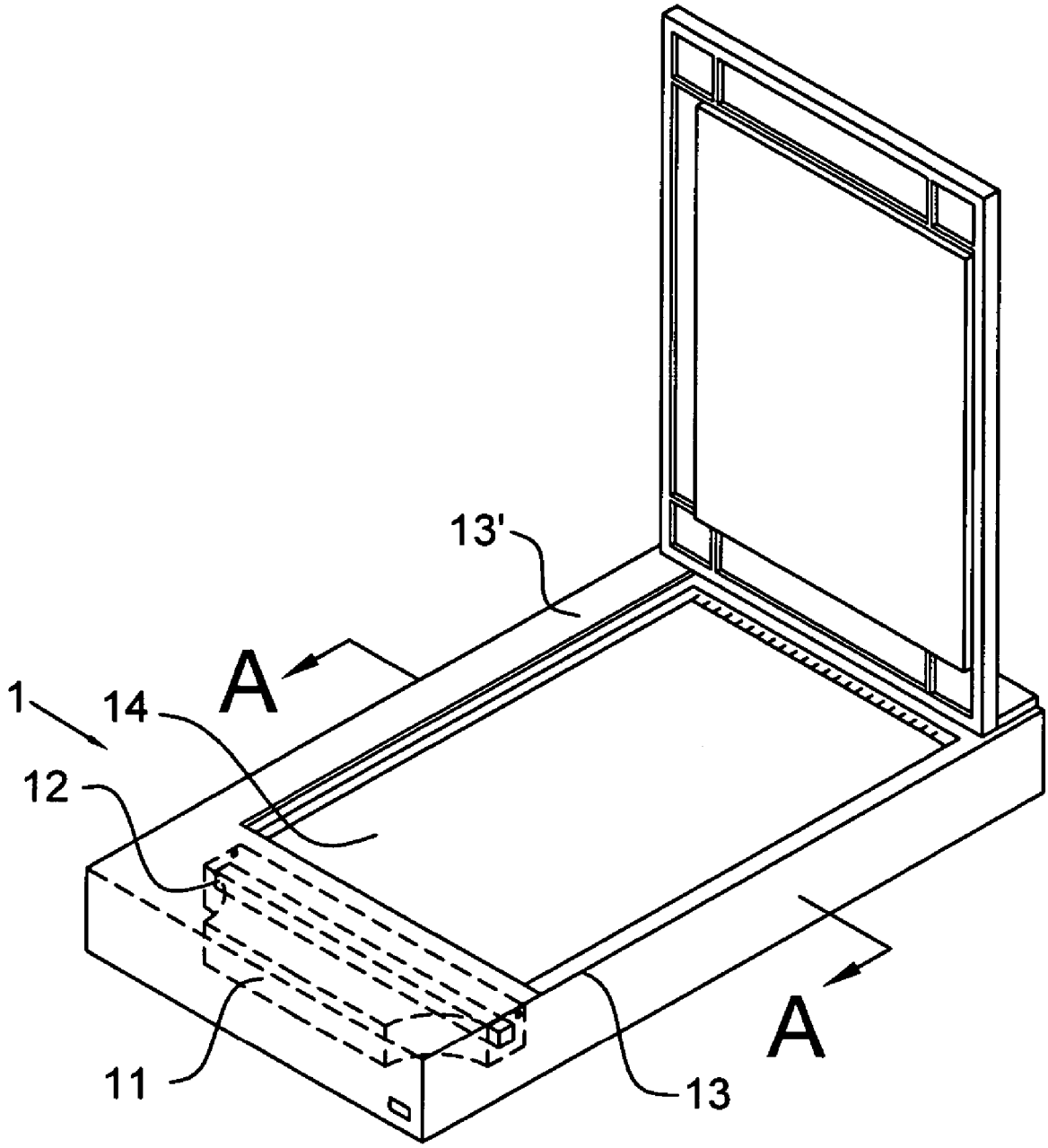
FIG. 1 is a stereographic diagram of a scanning system according to a first embodiment of the present invention.
Figures 1, 2:
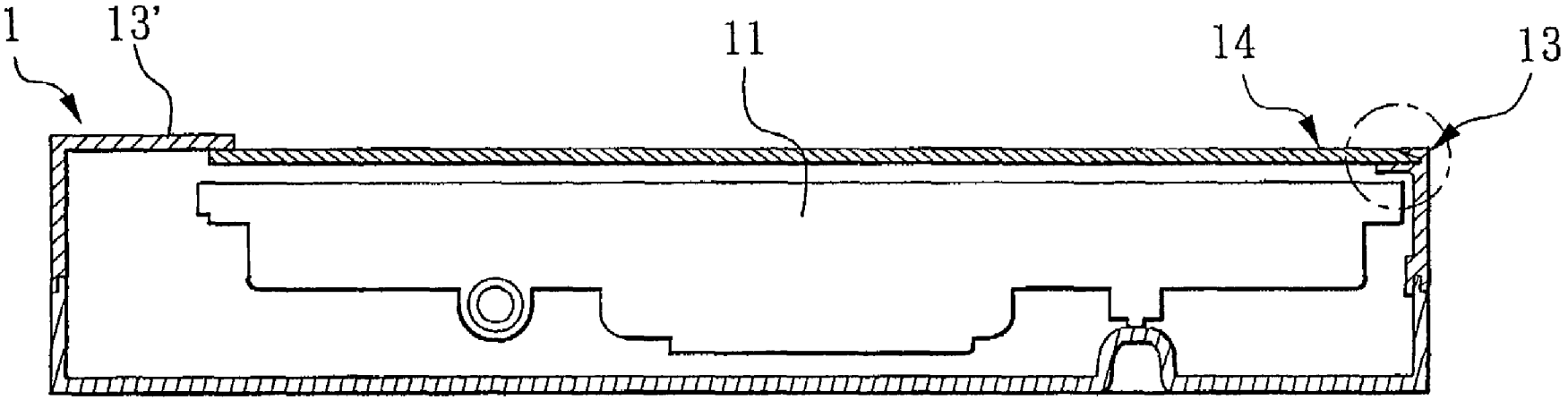
Figure 2:
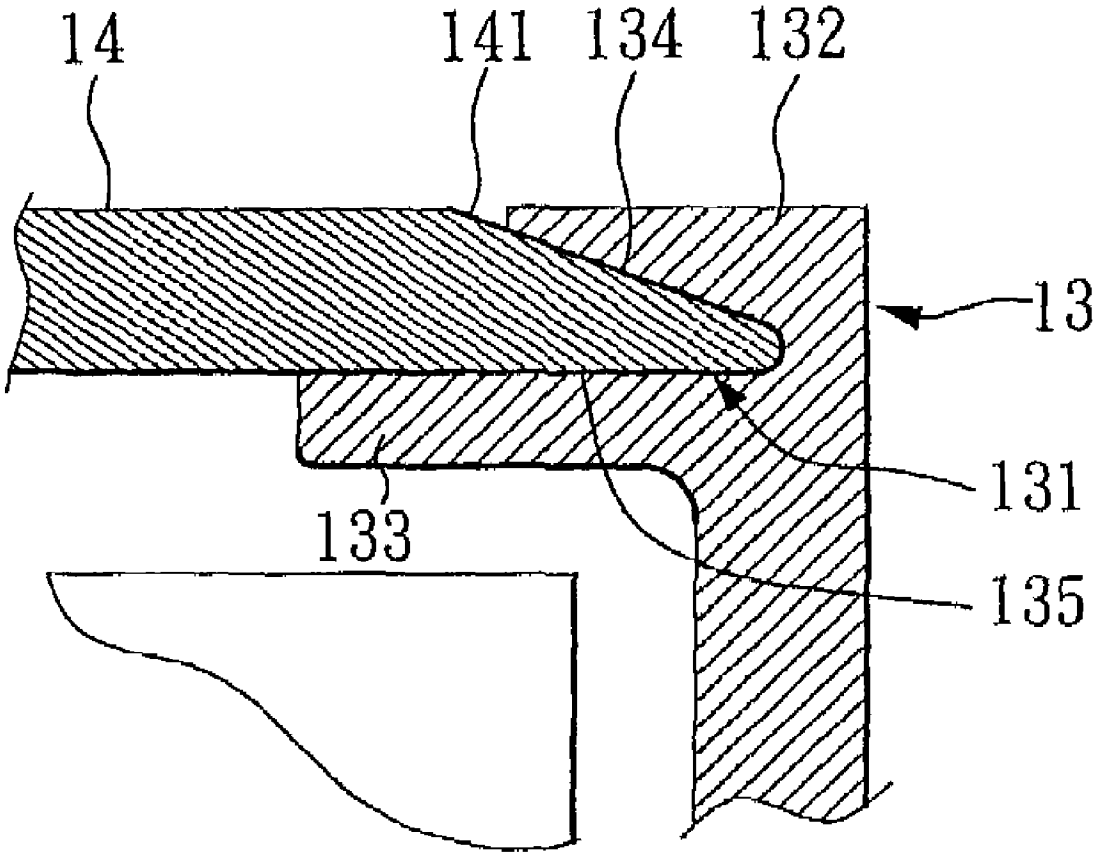

Please refer to FIGS. 1, 2-1, and 2-2. FIGS. 1, 2-1, and 2-2 are a stereographic diagram of a scanning system according to a first embodiment of the present invention, a cross-sectional view showing of A-A line of FIG. 1, and a partial view of FIG. 1 individually. As shown in FIGS. 1, 2-1, and 2-2, the scanning system for scanning a document placed on a document platen and for projecting an image onto a photosensitive image medium to form a latent image of the document thereon includes a housing 1, a photosensitive scanner 11, and a scanning window 14. Meanwhile, the photosensitive scanner 11 is adapted to move beneath the platen in a scan operation for projecting the image onto the photosensitive image medium to form the latent image. The scanning window 14 is mounted on a ceiling of the housing 1 and a fringe of the scanning window 14 bordered with frames 13, 13', wherein a top surface of the scanning window 14 is substantially equal to or higher than that of the frame 13 in height. Therefore, in scanning operation the bound part of the book can be placed in the frame 13 position so that the entire surface of the page being copied is in intimate contact with the platen surface.

Meanwhile, the scanning system further includes an orientation slot 131 disposed in the frame 13. The scanning window 14 has a downwardly sloping plane 141 engaged with the orientation slot 131. The orientation slot 131 includes an upper portion 132 and a lower portion 133 in which the upper portion 132 has a downwardly sloping plane 134 and the lower portion 133 has a horizontal plane 135 to form the orientation slot 131.

Additionally, in the present invention the photosensitive scanner 11 utilizes an illumination lamp which has two ends with L-shaped structures. It can effectively shorten the width of the frame 13 so as to provide a larger scan zone. The scanning window 14 is an exposure glass. Certainly, the photosensitive scanner can be one of a charge-coupled device or a contact image sensor.

Figure 3:
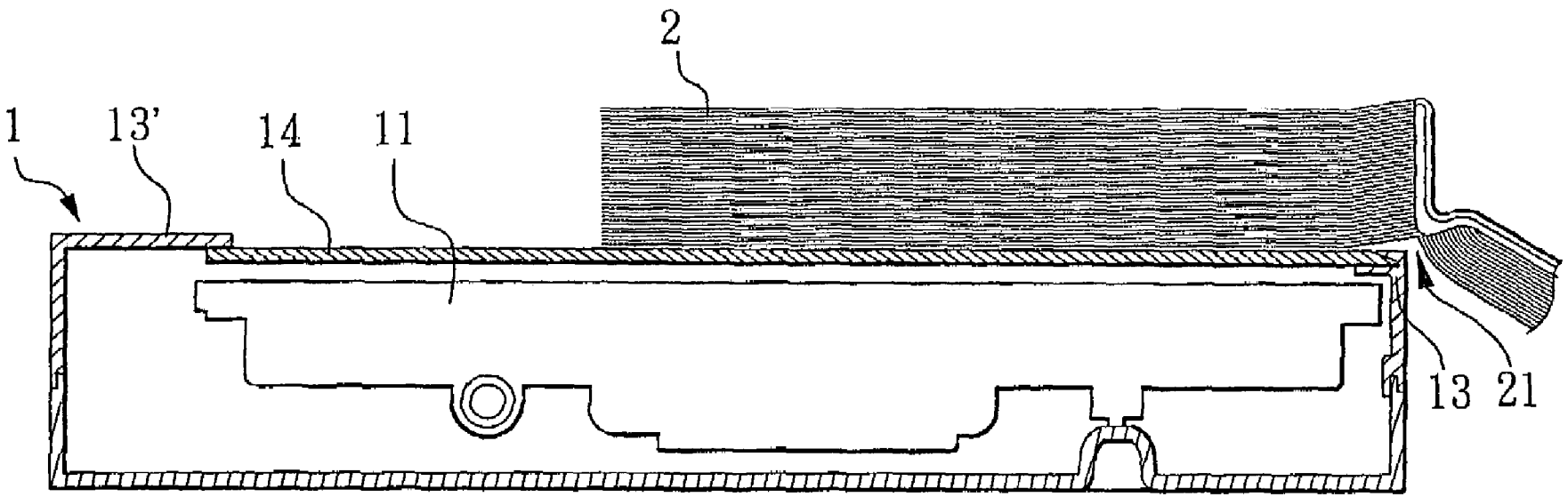
FIG. 3 is a schematic diagram of a scanning system according to a first embodiment of the present invention.

Please refer to FIG. 3. It is a schematic diagram of a scanning system according to a preferred embodiment of the present invention. According to the aforesaid, the bound part 21 of the book 2 can be placed in the frame 13 position so that the entire surface of the page being copied is in intimate contact with the platen surface. Therefore, the characters and figures in those portions of the sheet close to the binding area are not displaced or out of focus on the photosensitive drum resulting in dissatisfactory copying. Thus, the bound part of a book is held to the corner portion of the platen so that the entire surface of one page may securely be placed in intimate contact (flatly) on the surface of the platen.

Figure 4:
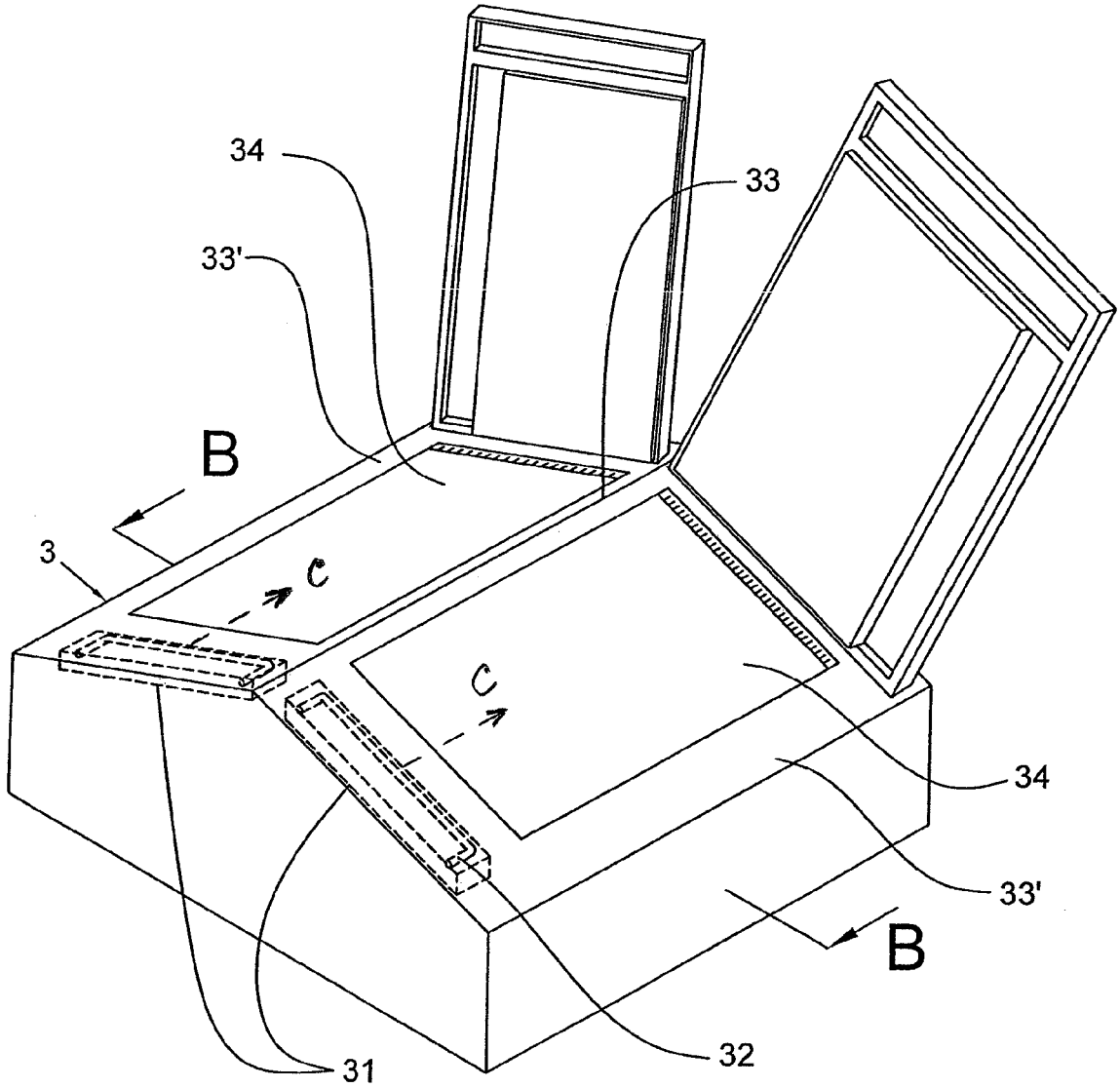
FIG. 4 is a stereographic diagram of a scanning system according to a second embodiment of the present invention.
Figures 1, 5:
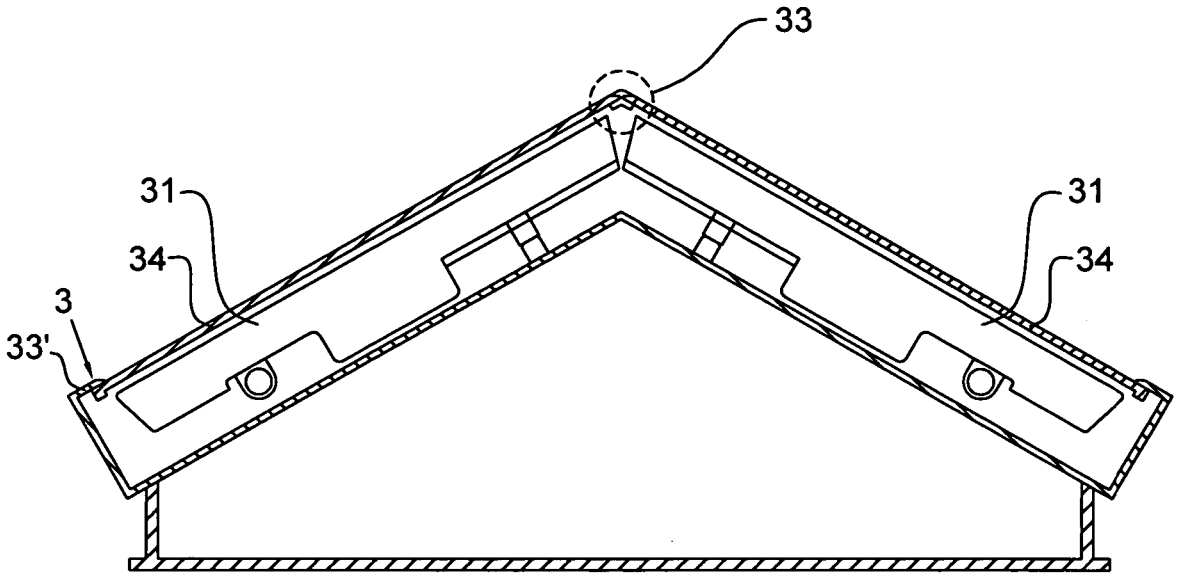
Figures 2, 5:
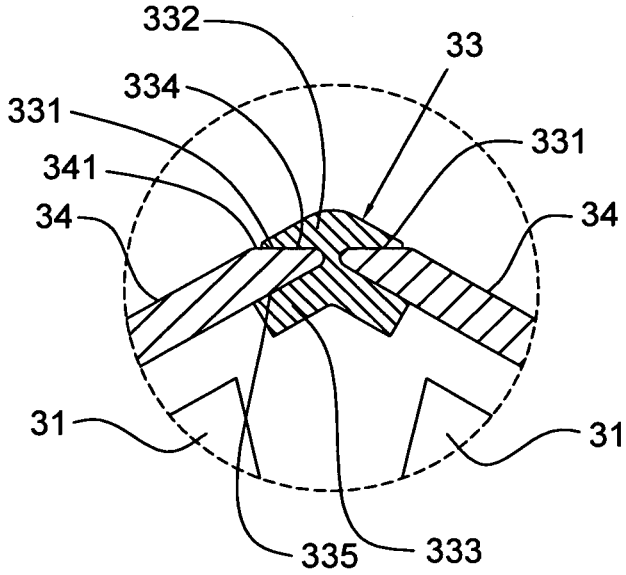

Referring to FIGS. 4, 5-1, and 5-2, they show a stereographic diagram of a scanning system according to a second embodiment of the present invention, a cross-sectional view along B-B line of FIG. 4, and a partial view of FIG. 4 individually. The scanning system in the second embodiment is substantially similar to the scanning system in the first embodiment wherein the similar elements are designated with the similar reference numerals. The scanning system includes a roof-shaped housing 3, a pair of photosensitive scanners 31, an illumination lamp 32, and a pair of scanning windows 34 (i.e., the two scanning windows 34 form a document platen). Meanwhile, the photosensitive scanners 31 is adapted to move beneath the document platen during scan operation for projecting an image onto a photosensitive image medium to form a latent image of the document. The two scanning windows 34 are mounted side by side above the roof-shaped housing 3. An outside fringe of each scanning window 34 is bordered with a frame 33', and an inside fringe between the two scanning windows 34 is bordered with a supporting frame 33, wherein top surfaces of the two scanning windows 34 are substantially equal to or higher than that of the supporting frame 33 in height. Therefore, during scan operation the bound part of the book can be placed in the supporting frame 33 position so that the entire surface of two consecutive pages which are simultaneously copied is in close contact with the surface of the scanning windows 34. As can be seen in FIG. 4, each photosensitive scanner 31 together with the respective illumination lamp 32 is moveable in a scanning direction C which is perpendicular to the longitudinal direction of the illumination lamp 32.

Meanwhile, the scanning system further includes a pair of orientation slots 331 which are disposed in two sides of the supporting frame 33. The supporting frame 33 can be an aluminum extrusion type frame or a frame made of metal material or plastic material. Each scanning window 34 has a downwardly sloping plane 341 engaged with the orientation slot 331. Each orientation slot 331 includes an upper portion 332 and a lower portion 333 in which the upper portion 332 has a downwardly sloping plane 334 and the lower portion 333 has a horizontal plane 335 to form the orientation slot 331.

Figure 6:
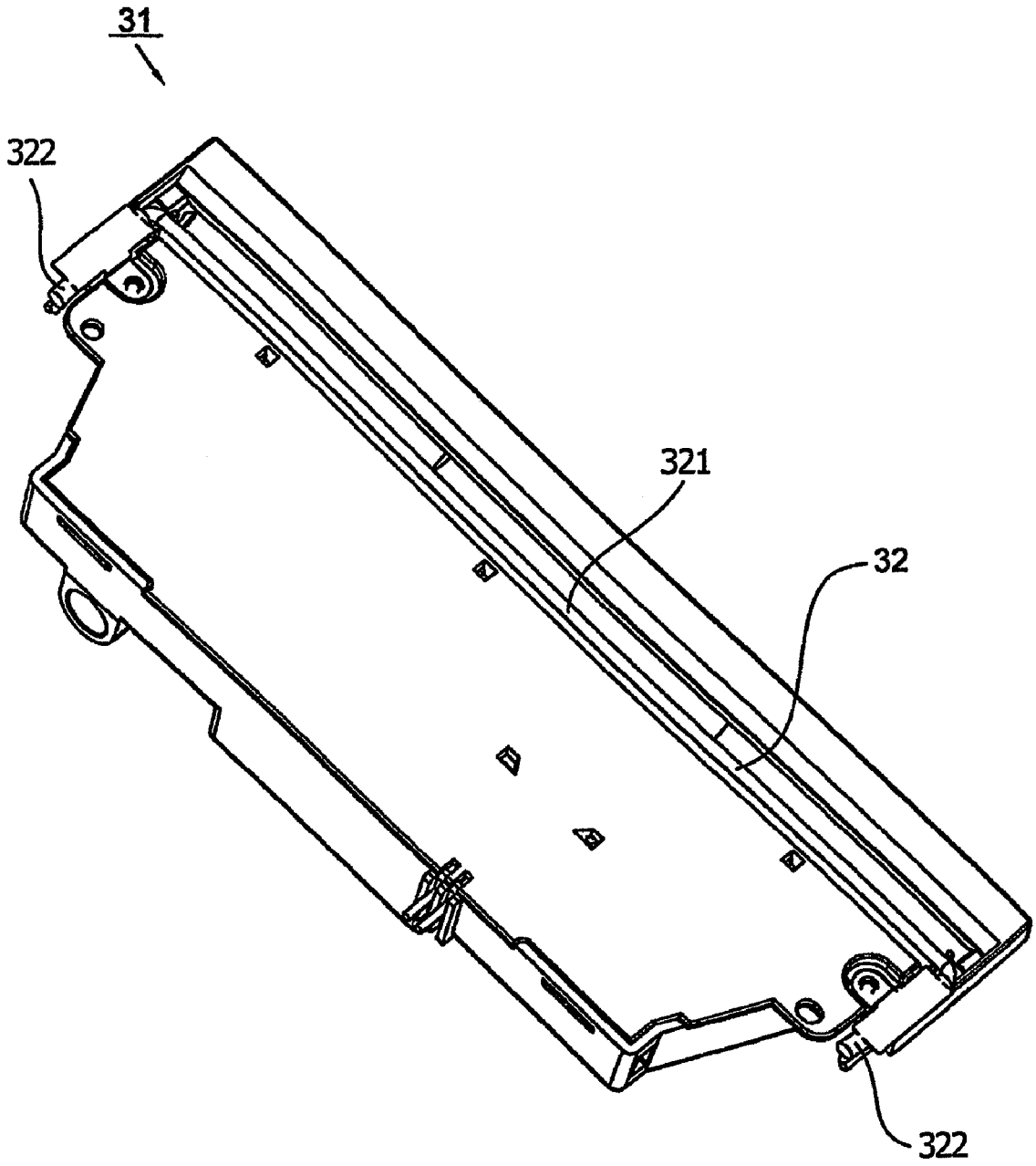
FIG. 6 is a stereographic diagram of a photosensitive scanner of a scanning system according to a second embodiment of the present invention.

Please refer to FIG. 6, it depicts that the photosensitive scanner 31 of the present invention is provided with an illumination lamp 32 having U-shaped structure. Compared with conventional photosensitive scanner using an illumination lamp with straight structure, the illumination lamp 32 with U-shaped structure can effectively shorten the distance between the scan zone of the photosensitive scanner 31 and the fringe of the roof shaped housing 3 so that the present invention can effectively shorten the width of the photosensitive scanner 31. The scanning window 34 is an exposure glass. Certainly, the photosensitive scanner 31 can be one of a charge-coupled device or a contact image sensor.

Figure 7:
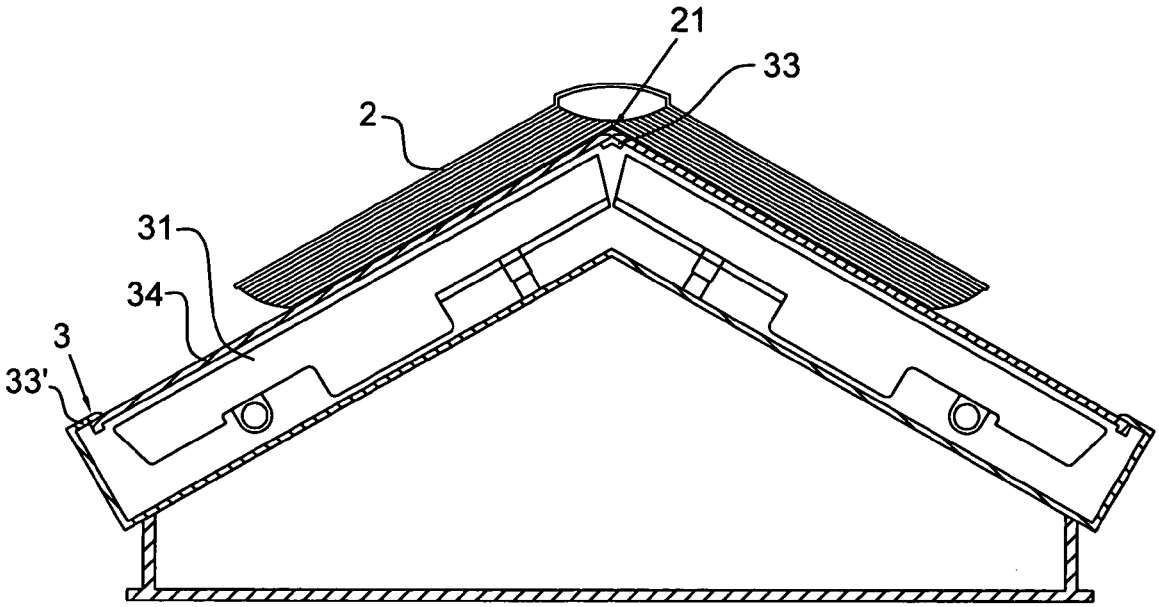
FIG. 7 is a schematic diagram of a scanning system according to a second embodiment of the present invention.

Please refer to FIG. 7, it is a schematic diagram of a scanning system according to a second embodiment of the present invention. According to the aforesaid description, the bound part 21 of the book 2 can be placed in the supporting frame 33 position so that the entire surface of two consecutive pages of the book 2 which are simultaneously copied is in close contact with the two scanning windows 34. Therefore, the characters and figures in those portions of the sheet close to the binding area are not displaced or out of focus on the photosensitive scanners 31 resulting in dissatisfactory copying. Thus, the bound part of a book 2 is held to the supporting frame 33 position so that securely the entire surface of two consecutive pages may be placed in close contact with the surface of the scanning windows 34.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A scanning system, comprising:

a housing;

a photosensitive scanner adapted to move beneath a document platen in a scan operation for scanning a document placed on the document platen and for obtaining a latent image of the document;

a scanning window mounted on a ceiling of said housing and a fringe of said scanning window bordered with a frame, wherein a top surface of said scanning window is substantially coelevational with or higher than that of one side of said frame; and an orientation slot disposed in said one side of said frame;

wherein an illumination lamp is moveable perpendicular to a longitudinal direction thereof, and said scanning window has a downwardly sloping plane engaged with said orientation slot.

2. A scanning system, comprising:

a roof-shaped housing;

a pair of photosensitive scanners adapted to move beneath a document platen during scan operation for scanning a document placed on the document platen and for obtaining a latent image of the document;

a pair of scanning windows mounted side by side above said housing, an outside fringe of each one of said pair of scanning windows being bordered with a frame, and an inside fringe between said pair of scanning windows being bordered with a supporting frame, wherein said pair of scanning windows form the document platen;

below each one of said pair of scanning windows, an illumination lamp moveable perpendicular to a longitudinal dimension thereof and along said inside fringe between said pair of scanning windows; and a pair of orientation slots disposed in two sides of said supporting frame, wherein each one of said pair of scanning windows has a downwardly sloping plane engaged with said orientation slot.

3. The scanning system of claim 2, wherein each said orientation slot comprises an upper portion and a lower portion, and said upper portion has a downwardly sloping plane and said lower portion has a horizontal plane to form said orientation slot.

* * * * *